United States Patent [19]

Brody et al.

[11] 4,391,080

[45] Jul. 5, 1983

[54] METHOD FOR PROVIDING AN INERT STERILE ATMOSPHERE IN AN ASEPTIC PACKAGING MACHINE

[75] Inventors: Aaron L. Brody, Dunwoody; Joseph J. Embro, Atlanta, both of Ga.; William E. Young, Neptune, N.J.

[73] Assignee: The Mead Corporation, Dayton, Ohio

[21] Appl. No.: 76,932

[22] Filed: Sep. 20, 1979

[51] Int. Cl.[3] ..... B65B 55/10

[52] U.S. Cl. ..... 53/426; 53/467; 53/167; 422/4; 422/302

[58] Field of Search ..... 53/425, 426, 467, 167; 426/399, 401, 410, 396; 422/29, 31, 4, 38, 302

[56] References Cited

U.S. PATENT DOCUMENTS

| | | | |
|---|---|---|---|
| 2,685,520 | 8/1954 | Martin | 53/426 X |
| 2,870,024 | 1/1959 | Martin | 426/399 |
| 2,978,336 | 4/1961 | Morrison | 426/393 |
| 3,180,740 | 4/1965 | Martin | 426/399 |
| 3,269,079 | 8/1966 | Schmied | 53/426 |
| 3,336,099 | 8/1967 | Czulak | 422/29 X |
| 3,376,689 | 4/1968 | Simpson | 53/426 |
| 3,634,099 | 1/1972 | Wilson | 53/425 |
| 3,820,300 | 6/1974 | Reinecke | 53/167 X |
| 3,854,874 | 12/1974 | Loliger | 53/167 X |
| 3,922,835 | 12/1975 | Reil | 53/167 |
| 4,014,158 | 3/1977 | Rausing | 53/167 |
| 4,152,464 | 5/1979 | Brody | 53/167 X |

FOREIGN PATENT DOCUMENTS

| | | | |
|---|---|---|---|
| 2459195 | 6/1976 | Fed. Rep. of Germany | 53/167 |

*Primary Examiner*—John Sipos

*Attorney, Agent, or Firm*—Erwin Doerr

[57] ABSTRACT

The invention relates to a method for providing a sterile inert atmosphere in an aseptic packaging machine wherein an inert gas is passed through a microbiological filter and then sparged through a bath of hot sterilizing liquid into the interior of the machine. A portion of the sterile inert gas is withdrawn from the machine interior by means of a suitable pump or blower, and separated into three parts; the first part being passed through a heater and then over the flange areas of containers passing through the machine to dry same prior to heat sealing operations, the second part being directed to the machine filler means to provide a back-up microbiological barrier for the filler, and the third part being passed through jets aligned on either side of a web of cover material as said cover material emerges from a sterilizing bath, said jets being arranged to blow off liquid sterilant adhering thereto.

6 Claims, 1 Drawing Figure

METHOD FOR PROVIDING AN INERT STERILE ATMOSPHERE IN AN ASEPTIC PACKAGING MACHINE

BACKGROUND OF THE INVENTION

This invention relates to a method for providing a sterile inert atmosphere in an aseptic packaging machine wherein an inert gas is passed through a microbiological filter and then sparged through a bath of hot sterilizing liquid into the interior of the machine. A portion of the sterile inert gas is withdrawn from the machine interior by means of a suitable pump or blower, and separated into three parts; the first part being passed through a heater and then over the flange sealing areas of containers passing through the machine to dry same prior to heat sealing operations, the second part being directed to the machine filler means to provide a back-up microbiological barrier for the filler, and the third part being passed through jets aligned on either side of the web of cover material as the cover material emerges from a sterilant bath, said jets being arranged to blow off liquid sterilant adhering to the cover web.

By definition, aseptic packaging is a packaging method whereby presterilized food product is filled into presterilized containers or cups under sterile conditions, the cups then sealed under sterile conditions, and the sealed cups delivered into commerce without further sterilization treatment. In other words, sterile food product, sterile containers and sterile covers are brought together in an atmosphere of sterile inert gas, combined into a package of a food product which requires no further sterilization, and one which does not require refrigeration during its useful shelf life of several months.

It is an object of this invention to provide a method of securing and maintaining an atmosphere of sterile inert gas within an aseptic packaging machine, said gas acting to seal the interior of the packaging machine from entry of microorganisms from the exterior.

It is a further object of this invention to provide a method of insuring that the head space of finished packages be filled with sterile inert gas at essentially atmospheric pressure.

It is a further object to provide a method for using sterile inert gas from the interior of the machine to dry the sealing flange areas of the containers or cups, and to remove liquid sterilant from the cover elements as said elements emerge from a sterilizing bath.

It is yet a further object to provide a method of using sterile inert gas from the interior of the machine to provide a back-up microbiological barrier for the filler section of the packaging machine, and to maintain a slight positive pressure in the interior of the machine.

Other objects will become evident from the description of the invention which follows.

PRIOR ART

Various earlier proposals have been made to provide a sterile inert atmosphere in the interior of an aseptic packaging machine. Of these, those utilizing steam as a sterile inert gas can be disregarded in connection with the present invention, since steam, even at atmospheric pressure, provides a temperature in excess of the heat deflection temperature of the plastic cups which are the preferred containers for use with the aseptic packaging methods. Likewise, prior methods predicated on the use of metal or glass containers are of no concern, since aseptic packaging was developed to make it possible to use containers which are made of appropriate plastic materials which cannot withstand the long retorting and high tempertures required for post packaging sterilization.

Representative of the art in this subject area is U.S. Pat. No. 2,549,216 (Martin) which teaches that sterilizing conditions can be maintained in the apparatus by continuously causing and maintaining a flow of a sterile scavenging gas, such as steam, nitrogen or sterile air through the apparatus, which sterile gas fills the apparatus and prevents entrance of outside bacteria-laden air through the entrance and exit and all other openings that may exist in the apparatus enclosure means. While primarily concerned with glass or metal containers, and use of steam at temperatures above 212° F., Martin does show filling the interior of a machine with sterile inert gas, but steam is the preferred material.

Kronquest, U.S. Pat. No. 2,268,289 describes apparatus having a filling and sealing chamber which has a sterile, non-oxidizing atmosphere therein. Glass or metal containers are the preferred choice.

SUMMARY OF THE INVENTION

The present invention relates to a method of mintaining a sterile, inert atmosphere in the interior portion of an aseptic packaging machine, and using the sterile inert gas to perform additional functions in the operation of the machine. From one view point, the body of sterile inert gas in the interior of the machine is used as a source of sterile inert gas for other functions, such as drying the sealing flange areas of the plastic cups, drying the web of cover material, and as a microbiological barrier for the filler section of the machine. Withdrawal of a portion of the sterile inert gas for these other functions amounts to a recycle of the withdrawn portion, since these functions are carried out within the interior of the packaging machine, and little or no gas is lost to the outside atmosphere.

The method of this invention is particularly adapted for use with the aseptic packaging method and machine shown and described in U.S. Pat. No. 4,152,464 and in U.S. patent application Ser. No. 973,681, filed Dec. 27, 1978, now abandoned both of which are assigned to the same assignee as this invention.

DETAILED DESCRIPTION

Figure 1:
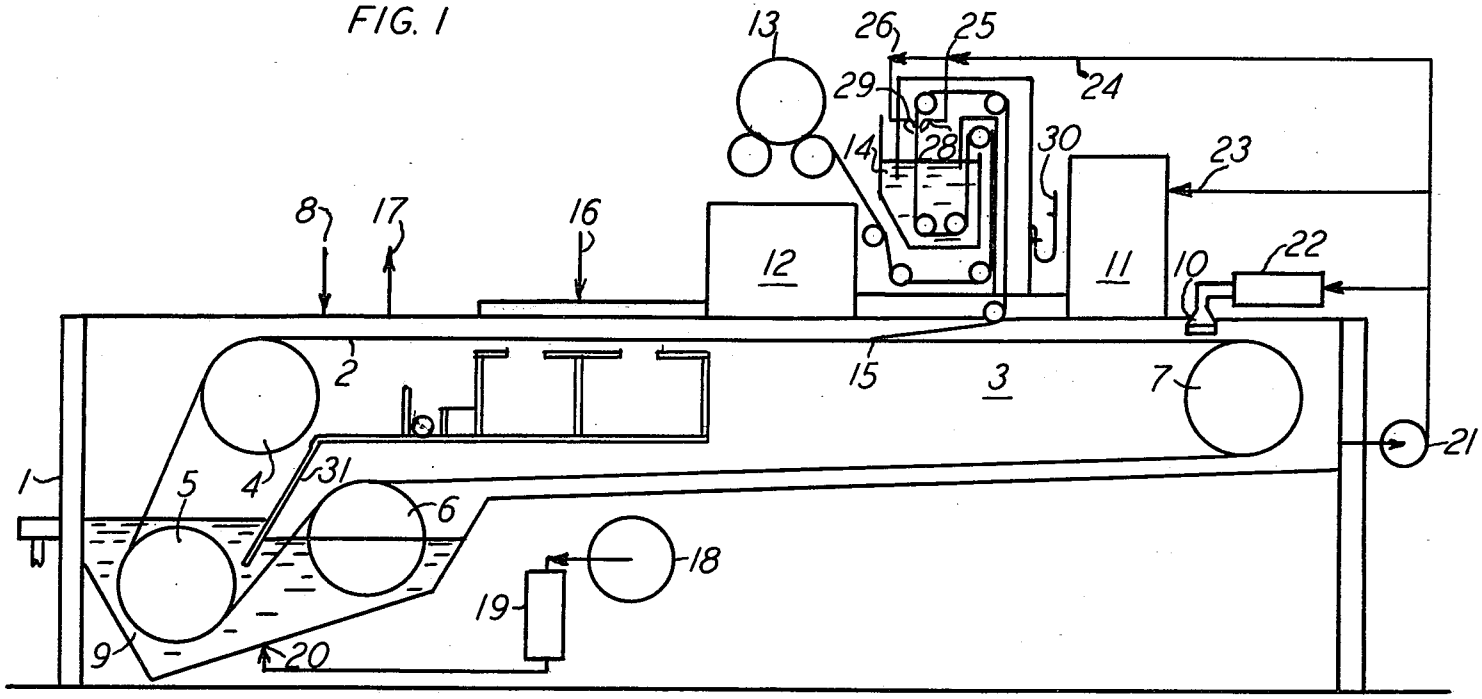
FIG. 1 is a diagrammatic sectional elevational view of one apparatus for carrying out the process of the invention.

With reference to FIG. 1, 1 indicates an aseptic packaging machine having cup conveying means 2 passing through a sterilant bath 9 and into the interior portion of the machine 3. The cup conveying means passes around drive and guide sprockets 4,5,6 and 7 so that cups fed into the machine at 8 are carried through the bath of hot sterilant 9, inverted and drained of sterilant between sprockets 6 and 7, turned open end up by sprocket 7. The cups are carried past flange drying means indicated by 10, filler means 11 and sealing means 12. A supply of web cover material 13 is passed through web sterilizing means 14 and brought into contact with the sealing flanges of the cups at 15. After sealing, the cups are carried past the microbiological barrier 16, and then are ejected from the machine as indicated at 17.

A supply of a suitable inert gas, such as nitrogen, is provided at 18. Conveniently, this can be a pressure tank containing liquid nitrogen. Nitrogen gas from supply 18 is passed through microbiological filter 19, said filter having a maximum pore size of less than 0.5 microns. This small pore size is sufficiently low to remove bacteria, yeasts and molds from the gas passing therethrough. After leaving the filter, the gas is sparged into the lower part of sterilant bath 9 as indicated at 20. After bubbling through the hot sterilant the gas passes into the interior portion of the machine 3. Note that the introduction of the gas to the bath as shown at 20 is located so that sealing baffle 31 prevents escape of the gas into the outside atmosphere. The liquid nitrogen of commerce has a very low microbial count, and the microbiological filter and passage through the hot sterilant bath reduce this count to essentially zero. Passage of the gas through the liquid sterilant serves to mix the sterilant, and concomitantly humidifies the gas as it enters the machine. Thus, the interior of the machine 3 is filled with sterile inert nitrogen, and cups filled and sealed in this internal atmosphere have only sterile inert nitrogen in the head space thereof. Increased shelf life for products so packaged results from the exclusion of oxygen therefrom, and from the absence of spoilage microorganisms. Gas pressure in the interior of the machine (3) is maintained at about 3 inches of water, to insure against entry of airborne microorganisms through minute leak areas. The interior portion of the machine 3 is sealed from the exterior by the cup sterilant bath 9, by the cover material sterilant bath 14, and by the microbiological barrier 16. Losses of sterile inert gas from the machine are small, and are limited essentially to the nitrogen leaving the system in the head space of the filled and sealed cups, and to minor amounts which are carried through the microbiological barrier 16.

A portion of the sterile inert gas is withdrawn from the interior of the machine by means of a suitable device, such as the enclosed centrifugal blower 21. The gas so removed from the machine is divided into three parts, as described below.

A first part is passed through a heater 22 and then blown over the sealing flange areas of the cups as indicated at 10. The action of the gas is to dry the sealing area to insure complete leak-proof seals of the final packaged product. Gas blown over the flange areas of the cups then mixes with the main volume of gas in the interior space 3 of the machine.

A second part of the gas is diverted to the filler 11 as indicated at 23, where said gas serves as additional microbial barrier, and assists in the operation of the filler.

The third part of the gas is passed to the cover material sterilizing bath 14 as indicated at 24. This gas flow is divided as indicated at 25, 26 and passed through slotted openings 28,29 to blow adhering liquid sterilant from both sides of the web of cover material, as said web emerges from the sterilant bath 14. The gas passing through the slotted openings will flow back into the interior portion 3 of the packaging machine. A manometer 30 indicates the pressure prevailing inside the machine, which is kept in the range of about 3 inches of water above atmospheric.

While the present invention has been described in relation to one embodiment of an aseptic packaging machine, it will be evident to those skilled in the art that the invention will apply to many other machines as well, without departing from the scope of the invention, which is defined by the following claims.

What is claimed is:

1. In a method for providing a sterile inert atmosphere in an aseptic packaging machine whereby inert gas is supplied to the interior of the machine and wherein preformed flanged containers are introduced into said interior through a sterilant bath, then filled by a filler means and thereafter covered with a cover material which is supplied through another sterilant bath, the improvement whereby said inert gas is introduced into the interior of said machine by sparging said gas into and through said container sterilant bath, and a portion of said gas is withdrawn from said interior, divided into three parts and delivered to (i) said containers for drying the flange areas thereof prior to filling and sealing, (ii) to said filler means to aid in the operation thereof and to provide a microbiological barrier therefor, and (iii) to said cover material as it emerges from said other sterilant bath for removing residual sterilant.

2. Method according to claim 1 wherein the inert gas is nitrogen.

3. Method according to claim 2 wherein said nitrogen gas is passed through a microbiological filter having a maximum pore size of less than 0.5 micron prior to being sparged through said container sterilant bath into the interior of said machine.

4. Method according to claim 1 wherein the part of the sterile inert gas withdrawn from the machine and delivered to container flanges is passed through a heater prior to delivery to said flange area.

5. Method according to claim 1 wherein the part of the sterile inert gas withdrawn from the machine and delivered to the cover material is passed through slotted openings to blow adhering liquid from said cover material.

6. A method for providing an inert sterile atmosphere in an aseptic packaging machine wherein the interior of said machine is sealed from the exterior by means including a first sterilant bath through which preformed flanged containers are supplied and a second sterilant bath through which a web of container cover material is supplied, and wherein said containers are filled by a filler means and then sealed with said cover material, comprising the steps of (a) withdrawing inert gas from a storage container and passing said gas through a microbiological filter having a pore size of less than 0.5 microns to remove microorganisms therefrom, (b) further sterilizing said inert gas and introducing the same into the interior of said machine by sparging said gas into and through said first sterilant bath, (c) withdrawing a portion of said gas from the interior of said machine, (d) heating a first part of said portion and blowing said first part over the sealing flange areas of said containers to dry said sealing flanges, (e) passing a second part of said portion into said filler means to aid in the operation of same and to provide a back-up microbiological barrier therefor, and (f) passing the remainder of said portion through slotted openings arranged on both sides of said web of cover material as it emerges from said second sterilant bath to remove residual sterilizing liquid therefrom.

* * * * *